US006339910B1

(12) United States Patent
Hähnel et al.

(10) Patent No.: US 6,339,910 B1
(45) Date of Patent: Jan. 22, 2002

(54) DEVICE FOR THE INSERTION OF PRODUCTS INTO A PACKAGING CONTAINER

(75) Inventors: Bernd Hähnel, Stutensee; Walter Dreizler, Minfeld, both of (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 09/420,422

(22) Filed: Oct. 19, 1999

(30) Foreign Application Priority Data

Oct. 21, 1998 (DE) ..... 198 48 452

(51) Int. Cl.[7] ..... B65B 1/04; B65B 35/30; B65B 35/50

(52) U.S. Cl. ..... 53/258; 53/539; 53/541; 53/544; 100/226; 414/788.2; 414/788.3; 414/798.7

(58) Field of Search ..... 53/544, 531, 541, 53/539, 257, 258; 100/226; 414/788, 788.2, 788.3, 788.9, 789.8, 798.7, 790, 791, 792.1

(56) References Cited

U.S. PATENT DOCUMENTS 2,373,781 A * 4/1945 Richardson ..... 17/25
2,439,725 A * 4/1948 Frost ..... 100/70
3,107,013 A * 10/1963 Euwe
3,204,506 A * 9/1965 Reinhold ..... 83/534
3,468,204 A * 9/1969 Haas et al. ..... 83/533
3,895,574 A * 7/1975 Nyborg ..... 101/37
4,550,549 A * 11/1985 Reinfeld et al. ..... 53/447
5,244,343 A * 9/1993 Lockert ..... 414/797
5,323,587 A * 6/1994 Amaranti ..... 53/155
5,564,893 A * 10/1996 Tacchi et al. ..... 414/796.9
6,058,684 A * 5/2000 Suokas ..... 53/529
6,059,519 A * 5/2000 Dutto et al. ..... 414/791.6

FOREIGN PATENT DOCUMENTS

DE 33 41 573 9/1984
DE 43 06 170 2/1994

* cited by examiner

*Primary Examiner*—Scott A. Smith
(74) *Attorney, Agent, or Firm*—Paul Vincent

(57) ABSTRACT

A device for insertion of products into a packaging container in a packaging machine comprises an insertion plunger which is guided along a certain path parallel to the product and a cover element which can be pre-positioned above the product by a first displacement control and which can be lowered onto the products via a second displacement control. The insertion plunger and the cover element can exercise an insertion motion to insert the products into the container. In order to guarantee a precise seating of the cover element and to facilitate a simple reconfiguration to differing product formats, the second displacement control comprises a substantially vertical control surface as well as an element engaging the control surface for horizontal displacement thereby, wherein the horizontal adjustment displacement of the element can be transformed by a transformation device into the vertical lowering motion of the cover element. In this manner, the control surface is substantially horizontally displaceable for format changing.

10 Claims, 3 Drawing Sheets

DEVICE FOR THE INSERTION OF PRODUCTS INTO A PACKAGING CONTAINER

This application claims Paris Convention priority of DE 198 48 452.6 filed Oct. 21, 1998 the complete disclosure of which is hereby incorporated by reference.

BACKGROUND OF THE INVENTION

The invention concerns a device for the insertion of products into a packaging container in a packaging machine with an insertion plunger guided along a certain path parallel to the products and a cover element which can be pre-positioned above a product by means of a first displacement control and which can be lowered onto the product by means of a second displacement control, wherein the insertion plunger and the cover element exercise a common insertion motion to introduce the product into the container.

Devices of the above mentioned kind are generally utilized in continuously operating packaging machines equipped e.g. with a product chain upon which the products to be packaged (tubes, bottles or a stack of blister pack strips) are transported. Containers, e.g. folded boxes, are guided parallel to the product chain for insertion of the product, optionally together with a brochure. This is effected with the assistance an insertion plunger which is likewise moved in the main transport direction parallel to the product chain by means of a chain transporter to carry out an insertion displacement perpendicular to the main transport direction.

Particularly for insertion of a stack of blister pack strips, it is necessary to slightly press the stack together and stabilize it prior to insertion. Toward this end, DE 43 061 731 proposes a cover element which is displaced above the stack of package strips in raised alignment and then lowered onto the pack. The cover element, together with the insertion plunger, then carry out an insertion motion in mutual cooperation, wherein the cover element seats on the stack of pack strips until they are received within the packaging container.

It is thereby important that the displacement dependence of the cover element be precisely tuned to the size of the products to be inserted. If the cover element prematurely seats on the stack of pack strips and is displaced under pressure on the upper side thereof before the stack is supported at its sides, the upper pack strip can be displaced as a result of which the desired stacked configuration is lost and the stack can no longer be inserted into the container. The height of the cover strip and its lowering and raising displacements are controlled by means of a curved path guide formed in an adjustable frame member in which a curve roller, borne for rotation about a horizontal axis, travels, to determine the height of the cover element. When a vertically lowermost section of the curved path is reached, the curve roller is lowered along with the cover element. In a vertically rising section of the curved path guide, the cover element is correspondingly lifted via the curve roller.

When the product to be packaged is changed, the overall height of the frame member in which the control curve is formed must be raised or lowered. This procedure is tedious, time consuming, and therefore expensive.

It is the underlying purpose of the invention to create a device of the above mentioned kind which guarantees a precise seating of the cover element and facilitates a simple reconfiguration to differing product formats.

SUMMARY OF THE INVENTION

This purpose is achieved in accordance with the invention with a device for insertion of products into a packaging container in that the second displacement control comprises a substantially vertical control surface and an element seating on the control surface for horizontal adjustment thereby, wherein the horizontal adjustment motion of the element can be transformed via a transformation device into the vertically lowering motion of the cover element.

The underlying concept of the invention is to deliver the cover element to the products, i.e. align it above the product stack and to effect the lowering of the cover element onto the product stack using two independent displacement controls. Since a format change normally requires only a change in the height of the product stack, whereas the delivery motion remains at least approximately constant, a format change only requires intervention in the second displacement control.

The separation between delivery and pre-positioning of the cover element and the lowering motion allows both displacements to be optimized, independent of each other, to the products to be packaged as well as to the structural boundary conditions within the machine, as a result of which a high functional reliability is imparted to the machine.

In accordance with the invention, the lowering and raising of the cover element is not effected by a vertically changing dependence of a horizontal control surface, rather by means of a horizontally changing dependence of a vertical control surface. The vertical control surface causes the element seating on the surface, which could be a curve roller borne for rotation about a vertical axis, to be horizontally adjusted. This horizontal adjustment of the curve roller is mapped by a transformation device, in particular in the form of a simple transfer system, into a vertically lowering and raising displacement of the cover element. This configuration has the advantage that a format change only requires displacement of the control surface in the machine in a horizontal direction along a guide. This is substantially simpler for the operator than is a vertical raising of an entire section of the frame member. Moreover, the control surface can be sidewardly removed from the machine and exchanged.

A particularly simple structural configuration of the control surface is given when the surface is fashioned on an adjustment plate which can be displaced to effect a format change, and which has a surface or surface structure engaged by the curve roller. A format change then only requires an adjustment of the adjustment plate.

In order to guarantee a secure seating of the curve roller on the control surface, it should be pre-tensioned against the control surface using a spring.

It has turned out to be particularly advantageous when the transformation device comprises a slanted linear guide which can be preferentially formed by a guide rod tilted with respect to the horizontal and vertical.

A preferred embodiment of the invention provides that the second displacement control comprises a control element which, can be vertically adjusted together with the cover element as a unit and which can be horizontally displaced relative to the cover element, wherein the curve roller seating on the control surface is borne on the control element. The substantially horizontal delivery motion of the cover element into the position above the product stack can thereby be effected without having to move the control element, since this element can be displaced horizontally relative to the cover element. The control element controls the vertical lowering of the cover element and engages, towards this end, the control surface via the curve roller. The diagonal linear guide allows the control element to follow the horizontal shape of the control surface or of the adjustment plate to thereby simultaneously experience a vertical displacement as a result of which the initial position for the lowering motion of the control member and thereby of the cover element can be changed. The relationship between the horizontal and vertical adjustment motion of the control element is given by the angle of the slanted guide rod, wherein an angle of 45° is preferentially provided so that the two displacement fractions are equal.

The first displacement control which controls the delivery and pre-positioning of the cover element, comprises a forward insertion carriage which can be displaced towards the product, which can be moved via a control curve, and which bears a vertical guide rod on which the cover element and the control element are borne in a vertically adjustable fashion. The cover element should seat in the above mentioned fashion from above on the product or the stack of pack strips and load same with a suitable, normally small amount of pressure.

This pressure can either be effected by the intrinsic weight of the cover element or, optionally, the cover element can be pre-tensioning via a spring when seating on the products.

Additional features and details of the invention can be extracted from the following description of an embodiment with reference to the drawing.

DESCRIPTION OF THE PREFERRED EMBODIMENT

Figure 1:
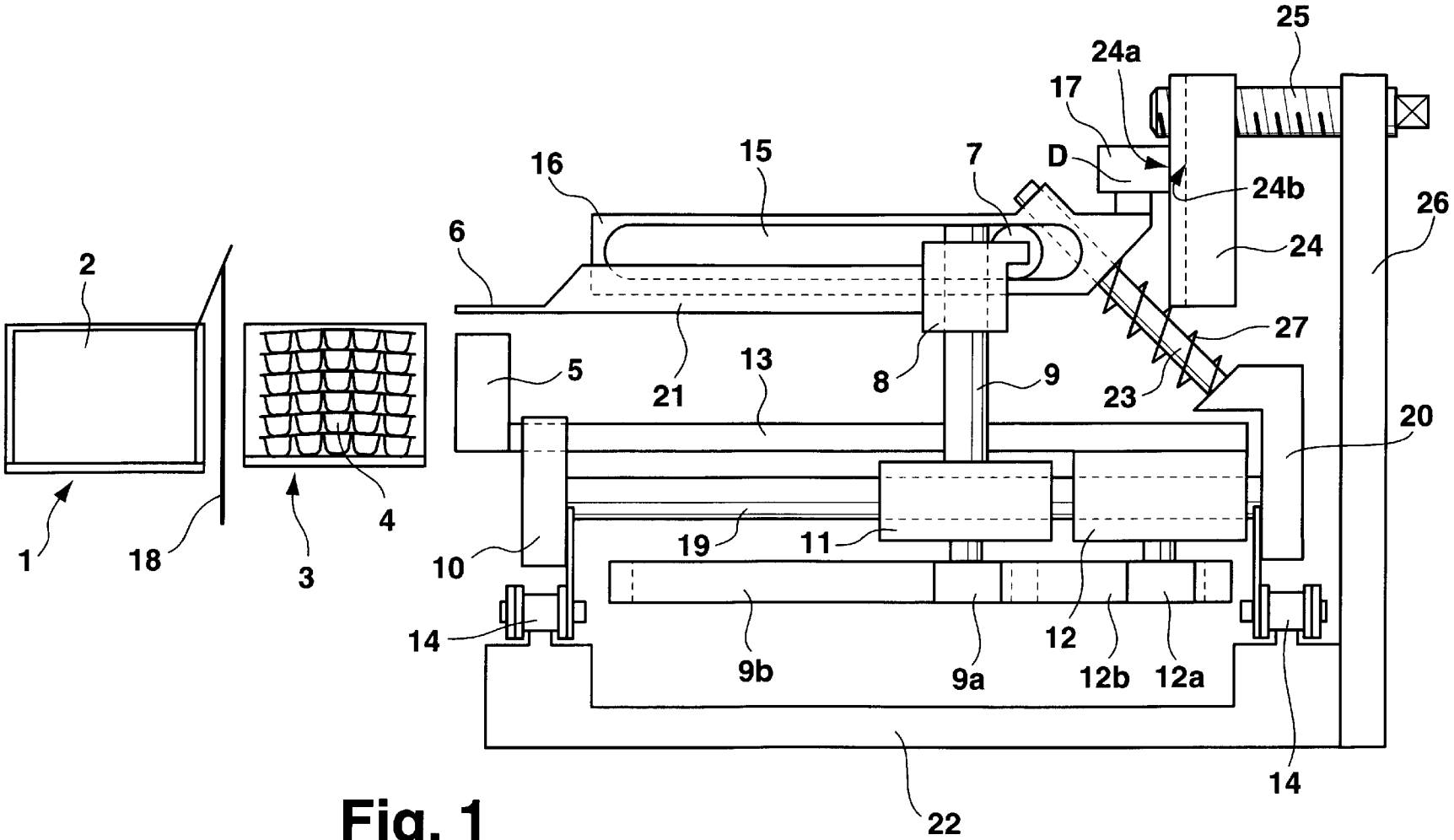
FIG. 1 shows a schematic side view of a packaging machine device in accordance with the invention, in a retracted position.

The packaging machine of FIG. 1 has a folded box transport chain 1 traveling in the main transport direction, i.e. perpendicular to the plane of the drawing parallel and adjacent to which, the product transport chain 3 runs. In the state shown, an erected folded box 2 is located on the folded box transport chain 1 and is open at its side facing the product transport chain 3. Products 4 in form of six vertically stacked blister pack strips are disposed on the product transport chain 3. A brochure 18 is disposed between the folded box 2 and the products 4 and is inserted into the folded box 2 together with the products 4.

A device for insertion of the products 4 into the folded box 2 includes a base 22 in which two mutually separated transport chains 14 travel in the main transport direction. A horizontal guide rod 19 extends between the transport chains 14 and has bearing blocks 10 and 20 respectively on each of its two ends, which are, in turn, each borne by one of the transport chains 14. A linear, diagonally disposed guide rod 23 is mounted to the bearing block 20 disposed on that side of the guide rod 19 facing away from the products 4, and extends at an angle of 45° in an upward direction towards the products 4.

A forward insertion carriage 11 is borne for longitudinal displacement on the horizontal guide rod 19 and bears a vertical guide rod 9 having a guide roller 9*a* on its lower end, seating on a control curve 9*b*. The control curve 9*b* is shown in a highly schematic fashion in FIG. 1 only, for reasons of clarity. The control curve 9*b* causes displacement of the forward insertion carriage 11 along the horizontal guide rod 19 in a predetermined fashion during passage through the packaging machine.

A longitudinally and vertically displaceable carriage 8 is disposed on the guide rod 9 and bears an arm 21 extending towards the product transport chain 3, the forward free end of which bears a flexible cover element 6. Displacement of the carriage 8 along the vertical guide rod 9 causes the arm 21 and the associated cover element 6 to be vertically raised and lowered. A roller 7 is borne for rotation on the carriage 8 and engages into a horizontal guide groove 15 formed in the control element 16 which, in turn, is seated for longitudinal displacement along the diagonal guide rod 23 and pre-tensioned in a downward diagonal direction by a tension spring 27. A curve roller 17 is borne on the control element 16 for rotation about a vertical axis D and rolls along a substantially vertical control surface 24*a* formed in a vertical adjustment plate 24. The curve roller 17 is pressed against the control surface 24*a* by the tension spring 27 disposed on the diagonal guide rod 23. The adjustment plate 24 can be adjusted along a horizontal guide rod 25 borne on a vertical stand 26.

In addition, an axially displaceable insertion carriage 12 is disposed on the horizontal guide rod 19 which also has a guide roller 12*a* seating on a control curve 12*b*. The control curve 12*b* is shown in a highly schematic fashion in FIG. 1 only, for reasons of clarity. An insertion plunger 13 is borne on the insertion carriage 12 and extends up to the product transport chain 3. Proximate its free end, the insertion plunger 13 passes through a guide in the bearing block 20 and bears an insertion member 5 at its front free end, the height of which corresponds substantially to the height of the products 4 to be packaged.

Figure 2:
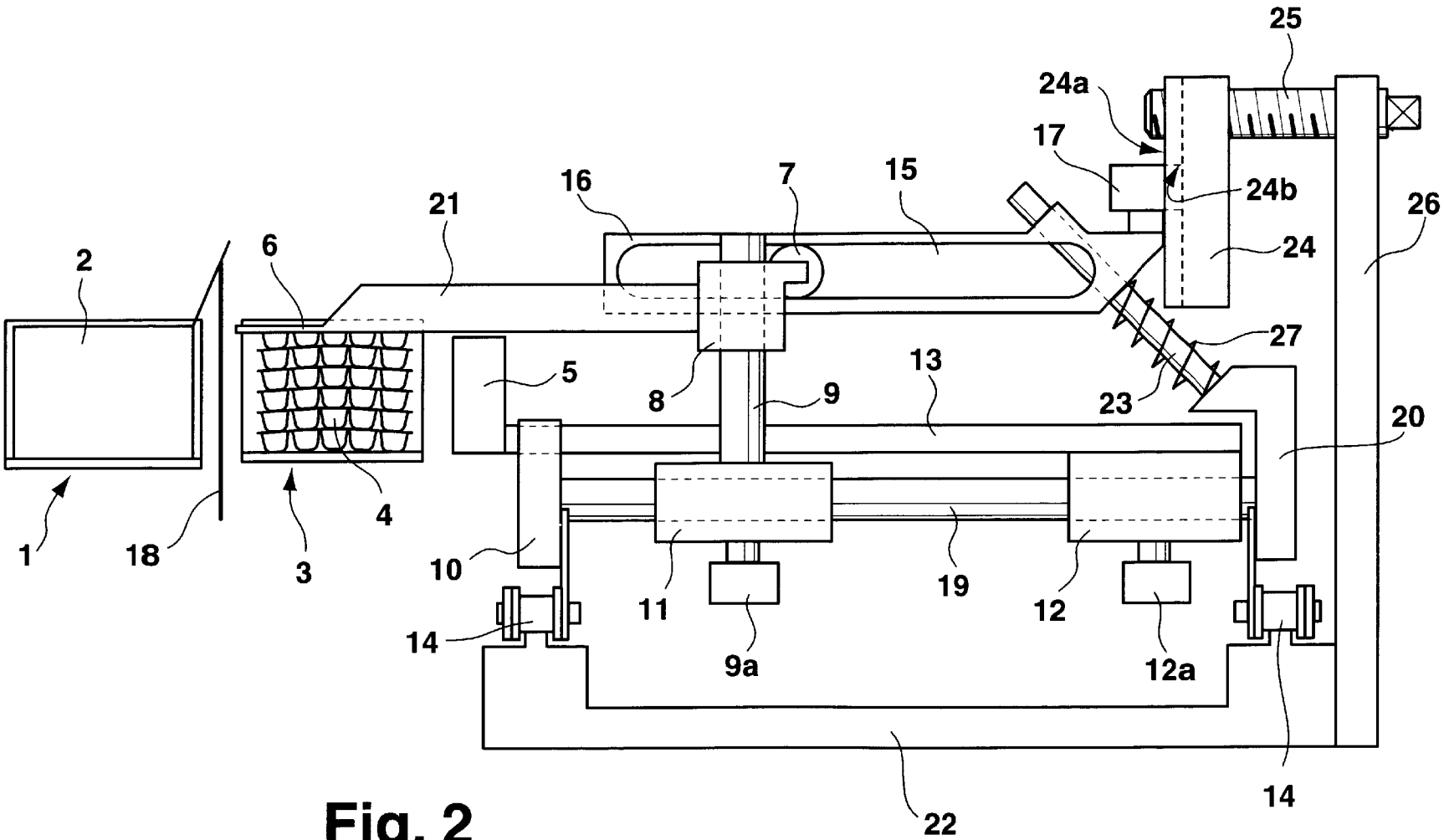
FIG. 2 shows the device according to FIG. 1 shortly after seating of the cover element and FIG. 3 shows a view corresponding to FIG. 2 with a changed product format.

An insertion cycle is now described with reference to FIGS. 1 and 2. In the retracted position shown in FIG. 1, the arm 21 and the cover element 6 formed thereon are located in a retracted position in which the roller 7 is disposed within the guide groove 15 proximate the end facing away from the products 4 and the curve roller 17 seats on the outer side of the adjustment plate 24, i.e. the control curve 24*a*, wherein the cover element 6 is disposed above and retracted away from the products 4.

During passage through the packaging machine, the forward insertion carriage 11 is initially displaced, in accordance with the figures, towards the left along the horizontal guide rod 19, i.e. towards the product transport chain 3, as a result of which the arm 21 with the cover element 6 are displaced towards the left, wherein the roller 7 rolls within the horizontal guide groove 15 to thereby hold the arm 21 and the cover element 6 above the products 4. The forward insertion carriage 11 is displaced until the cover element 6 is disposed above the products 4.

By further passage through the packaging machine, the curve roller 17 gains access into a section of the control surface 24*a* of the adjustment plate 24 having a recess 24*b*, as a result of which the tension spring 27 causes the control element 16 to move towards the right in accordance with FIG. 1. The diagonal guide rod 23 however forces linear travel for the control element 16 so that the rightwardly directed horizontal motion simultaneously leads to a vertically downward motion. This vertical lowering of the control member 16 leads to a corresponding lowering of the roller 7, as a result of which the carriage 8 is moved downwardly along the vertical control rod 9. This causes the arm 21 which is connected to the carriage 8 to be lowered until the cover element 6 seats from above on the products 4 and stabilizes same. This situation is shown in FIG. 2. In the event of very sensitive products, it is also possible to hold the cover element 6 directly above the product 4 without exercising force thereon.

During further passage through the packaging machine, the guide rollers 12*a* of the insertion carriage 12 are displaced via the curved path guide 12*b* to move the insertion carriage 12 along the horizontal guide rod 19 towards the product transport chain 3 and thereby towards the folded box transport chain 1 (towards the left in accordance with the figures). The insertion carriage 11 simultaneously experiences an associated motion to displace the cover element 6 and the insertion member 5 in a mutually cooperating fashion for insertion of the products 4 and the brochure 18 into the folded box 2. The forward insertion carriage 11 and the insertion carriage 12 are then retracted and the curve roller 17 leaves the recess 24*b* in the control surface 24*a* of the adjustment plate 24 to once more assume the initial position shown in FIG. 1.

Figure 3:
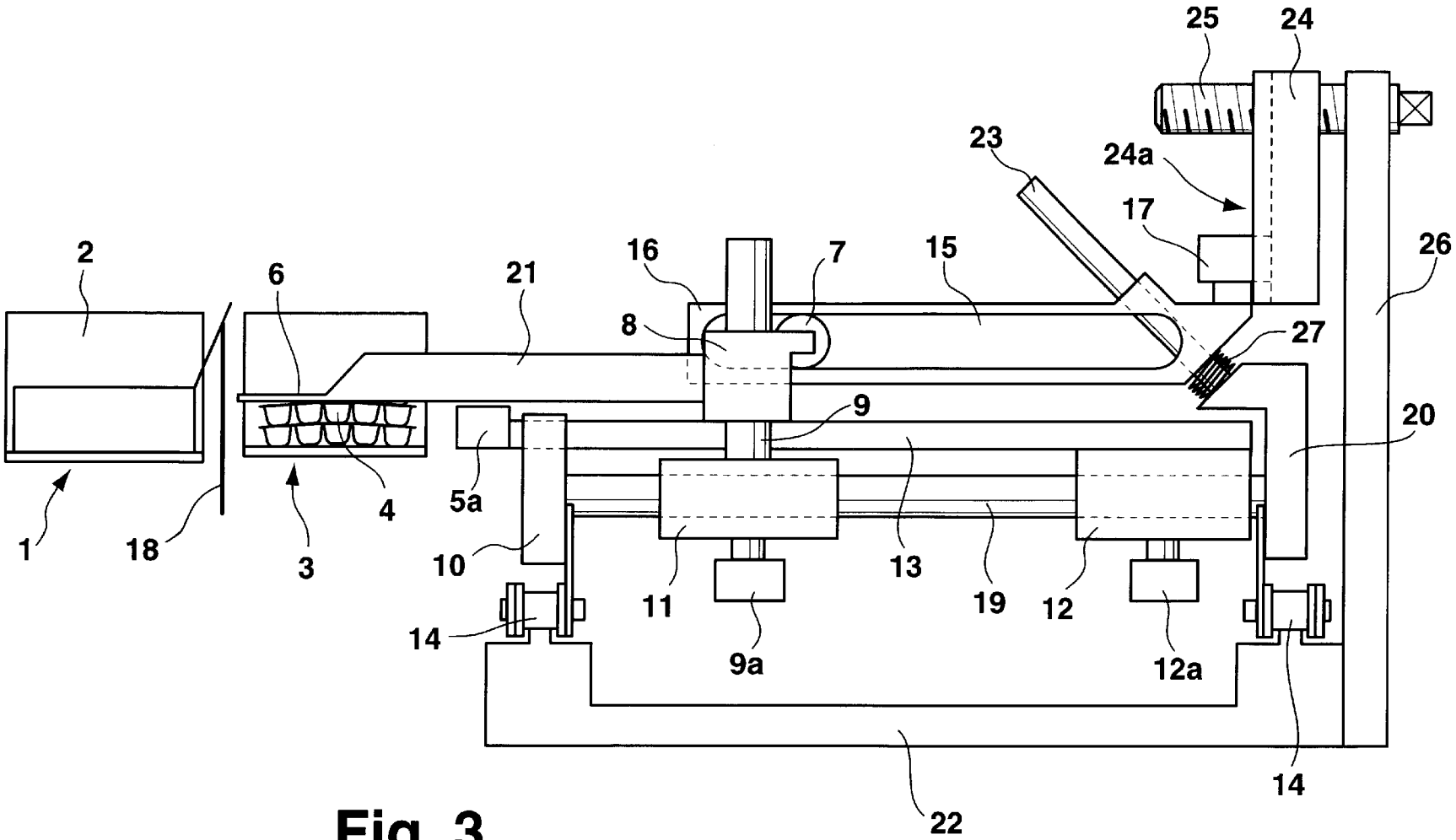

As can be seen from the previous description, the raised height of the cover lid 6 in its initial position above the products is controlled by the position of the adjustment plate 24, whereas the vertical lowering of the cover lid 6 is derived from the depth of the recess 24*b* in the adjustment plate 24 in cooperation with the curve roller 17 and the diagonal guide rod 23. In order to effect a format change, the adjustment plate 24 can be displaced horizontally along the guide rod 25 to thereby change the initial height of the cover element 6. If the adjustment plate 24 is not exchanged, the degree of vertical lowering of the cover element 6 remains unchanged. FIG. 3 shows a representation after effecting a format change by displacement of the adjustment plate 24, wherein the insertion member 5 has been exchanged for an insertion member 5*a* of differing size.

We claim:

1. A device for insertion of products into a packaging container in a packaging machine, the device comprising:

a frame;

a cover element;

an insertion plunger guided along a path parallel to the products;

a first displacement control mounted to said frame and communicating with said cover element and said insertion plunger for substantially horizontal displacement thereof to pre-position said cover element above the products and to cause said insertion plunger and said cover element to exercise a mutually cooperative insertion motion for insertion of the products into the container; and a second displacement control mounted to said frame, said second displacement control having a substantially vertical control surface means, a first control element seating on said control surface means for horizontal displacement thereon, means for connecting said first control element to said cover element, and a transformation device communicating with said connecting means for transforming said horizontal displacement of said first control element into a vertical lowering of said cover element onto the products, wherein said connecting means comprise means for substantially decoupling a horizontal displacement of said cover element effected by said first displacement control from a vertical positioning of said cover element effected by said vertical control surface means in cooperation with said transformation device.

2. The device of claim 1, further comprising means, mounted to said frame, for displacing said control surface means in a substantially horizontal manner to change a format.

3. The device of claim 2, wherein said control surface means comprises control surface formed on an adjustment plate.

4. The device of claim 1, wherein said first control element comprises a curve roller.

5. The device of claim 4, further comprising spring means for biasing said curve roller against said control surface means.

6. The device of claim 1, wherein said transformation device comprises a slanted linear guide.

7. The device of claim 6, wherein said slanted linear guide comprises a guide rod titled with respect to a horizontal as well as with respect to a vertical.

8. The device of claim 1, wherein said connecting means comprises a second control element communicating with said transformation device and mounted for displacement in a vertical direction as a unit together with said cover element, said second control element having means for allowing horizontal displacement thereof relative to and substantially independent of a horizontal positioning of said cover element, wherein said first control element is borne on said second control element.

9. The device of claim 8, wherein said transformation device comprises a slanted linear guide and wherein said second control element is constrained to travel along said slanted linear guide.

10. The device of claim 1, wherein said first displacement control comprises a forward insertion carriage bearing a vertical guide rod on which said cover element is borne for vertical displacement, said first displacement control also comprising means for guiding said forward insertion carriage along a control path to displace said forward insertion carriage towards the products.

* * * * *